US009084517B2

(12) United States Patent
Jenkins

(10) Patent No.: US 9,084,517 B2
(45) Date of Patent: Jul. 21, 2015

(54) TOILET SEAT COVER AND METHOD OF USING SAME

(71) Applicant: Yvonneda Jenkins, Charlotte, NC (US)

(72) Inventor: Yvonneda Jenkins, Charlotte, NC (US)

( * ) Notice: Subject to any disclaimer, the term of this patent is extended or adjusted under 35 U.S.C. 154(b) by 0 days.

(21) Appl. No.: 13/759,574

(22) Filed: Feb. 5, 2013

(65) Prior Publication Data

US 2014/0215701 A1 Aug. 7, 2014

(51) Int. Cl.
*A47K 13/16* (2006.01)

(52) U.S. Cl.
CPC ..... *A47K 13/16* (2013.01)

(58) Field of Classification Search
CPC ..... A47K 13/16
USPC ..... 4/245.1–245.9
See application file for complete search history.

(56) References Cited

U.S. PATENT DOCUMENTS

| | | | | |
|---|---|---|---|---|
| 1,522,699 | A * | 1/1925 | Reid | 4/245.8 |
| 4,407,024 | A | 10/1983 | Schneider | |
| 5,144,698 | A * | 9/1992 | McKenzie | 4/245.5 |
| 5,557,809 | A * | 9/1996 | Adams | 4/245.3 |
| 6,038,711 | A | 3/2000 | Clarke | |
| 6,851,131 | B1 * | 2/2005 | Adams | 4/245.1 |
| 7,247,360 | B1 | 7/2007 | Besner et al. | |
| 8,196,228 | B1 * | 6/2012 | Gyurjyan | 4/245.1 |
| 2002/0184701 | A1 * | 12/2002 | Johnson | 4/245.5 |
| 2009/0255040 | A1 * | 10/2009 | Massey, Jr. | 4/245.4 |
| 2010/0313342 | A1 * | 12/2010 | Liu | 4/245.6 |
| 2011/0067171 | A1 * | 3/2011 | Kouadio | 4/245.1 |
| 2011/0099699 | A1 * | 5/2011 | Spievey et al. | 4/245.8 |

FOREIGN PATENT DOCUMENTS

| | | |
|---|---|---|
| WO | WO9934720 | 7/1999 |

* cited by examiner

*Primary Examiner* — Lori Baker

(57) ABSTRACT

A cover for positioning on a toilet can include a central seat section for positioning on a toilet seat having a central opening formed therein for communicating with an interior of a toilet bowl, and first and second side pocket sections connected to the central seat section at opposed positions. The side pocket sections extend downwardly on opposite sides of the toilet when the central seat section is positioned on the toilet seat, and each side pocket section can receive a hand of a person seated on the toilet cover. The first and second side pocket sections can be attached to the central seat section along first and second lines of perforation, such that the first and second side sections are removable from the central seat section by tearing along the lines of perforation.

19 Claims, 4 Drawing Sheets

TOILET SEAT COVER AND METHOD OF USING SAME

TECHNICAL FIELD AND BACKGROUND OF THE INVENTION

The present invention relates to a toilet seat cover. An embodiment of the invention comprises a toilet seat cover that protects a user's hands from exposure to unwanted contaminants.

Many people are understandably concerned about being exposed to bacteria, viruses and other unwanted contaminants when using a toilet, particularly in a public restroom. Therefore, disposable toilet seat covers have been developed to cover the toilet seat while the user is seated on the toilet.

Using a public restroom toilet can be particularly problematic for children, whose legs often cannot reach the floor when seated on the toilet. In addition, children are more likely than adults to move their hands while seated on the toilet, and allow their hands to directly contact the toilet.

SUMMARY OF THE INVENTION

Therefore, one object of the present invention is to provide a toilet seat cover having protective enclosures in which the user can position his or her hands, while seated on a toilet. Another object of the invention is to provide a toilet seat cover having protective enclosures that can be removed from the cover so that the user can freely move his hands while maintaining his hands in the enclosures. These and other objects of the present invention can be achieved in the preferred embodiments of the invention described below.

One embodiment of the invention comprises a cover apparatus for positioning on a toilet comprising a central seat section for positioning on a toilet seat having a central opening formed therein for communicating with an interior of a toilet bowl, and first and second side pocket sections connected to the central seat section at opposed positions. The side pocket sections extend downwardly on opposite sides of the toilet when the central seat section is positioned on the toilet seat, and each side pocket section is adapted for receiving a hand of a user of the apparatus. The first side pocket section is attached to the central seat section along a first line of perforation and the second side pocket section is attached to the central section along a second line of perforation, whereby the first and second side sections are removable from the central seat section by tearing along the first and second lines of perforation.

According to another embodiment of the invention, each of the first and second side pocket sections comprise a substantially rectangular envelope having a front panel attached to a back panel, and a top opening for receiving the hand of the user.

According to another embodiment of the invention, the back panel of the first side pocket section is attached to the central seat section along the first line of perforation, and the back panel of the second side pocket section is attached to the central seat section along the second line of perforation.

According to another embodiment of the invention, a front flap section is connected to the central seat section at a front outer edge of the central seat section. The front flap section extends downward when the central seat section is positioned on a toilet seat, and provides a barrier between the user's legs and the toilet.

According to another embodiment of the invention, the central seat section includes an inner protective section extending around the opening of the central seat section, and extends downward partially into the interior of the toilet bowl when the central seat section is positioned on the toilet seat. The inner protective section provides a barrier between the user and the interior of the toilet bowl.

According to another embodiment of the invention, the central seat section includes an in-bowl flap section extending downward proximate a bottom of the interior of the toilet bowl when the central seat section is positioned on a toilet seat. The flap section contacts water in the toilet bowl to facilitate evacuation of the apparatus upon flushing of the toilet.

According to another embodiment of the invention, a rear flap section can be connected to the central seat section at a rear outer edge of the central seat section.

According to another embodiment of the invention, the central seat section and the first and second side sections are comprised of a top layer comprising a two-ply soft tissue, and a bottom layer comprising a water soluble plastic.

According to another embodiment of the invention, the bottom layer is comprised of polyvinyl alcohol.

According to another embodiment of the invention a cover apparatus comprises a central seat section adapted for positioning on a toilet seat. The central seat section has a central opening formed therein for communicating with an interior of a toilet bowl, and left and right side pocket sections are connected to the central seat section at opposed positions. The left side pocket section extends downwardly on a left side of the toilet and the right side pocket section extends downwardly on a right side of the toilet when the central seat section is positioned on the toilet seat. Each side pocket section is comprised of an envelope having a front panel attached to a back panel, and has a top opening for receiving a hand of a user seated on the toilet. The back panel of the first side pocket section is attached to the central seat section along a first line of perforation, and the back panel of the second side pocket section is attached to the central seat section along a second line of perforation, such that the first and second side sections are removable from the central seat section by tearing along the first and second lines of perforation.

According to another embodiment of the invention, the toilet cover has a top layer comprised of two-ply soft tissue, and a bottom layer comprised of a water soluble plastic.

According to another embodiment of the invention, the bottom layer comprises polyvinyl alcohol.

According to another embodiment of the invention, a front flap section is connected to the central seat section at a front outer edge of the central seat section, and extends downward when the central seat section is positioned on a toilet seat, providing a barrier between the user's legs and the toilet.

According to another embodiment of the invention, the left side pocket section, the right side pocket section, the front flap section and the rear flap section are substantially rectangular.

According to another embodiment of the invention, the central seat section opening is substantially oval shaped, and the first and second lines of perforation have a concave curvature.

According to another embodiment of the invention, the central seat section includes an inner protective section extending around the opening of the central seat section, and extends downward partially into the interior of the toilet bowl when the central seat section is positioned on the toilet seat. As such, the inner protective section provides a barrier between the user and the interior of the toilet bowl.

According to another embodiment of the invention, the central seat section includes an in-bowl flap section extending downward proximate a bottom of the interior of the toilet bowl when the central seat section is positioned on a toilet seat, such that the flap section contacts water in the toilet bowl to facilitate evacuation of the apparatus upon flushing of the toilet.

According to another embodiment of the invention, a method of providing a barrier between a toilet and a user seated on the toilet includes providing a toilet seat cover comprising a central seat section having an opening formed therein for communicating with an interior of a toilet bowl, and left and right side pocket sections connected to the central seat section at opposed positions. The side pocket sections extend downwardly on opposite sides of the toilet when the central seat section is positioned on the toilet seat, and each side pocket section adapted for receiving a hand of a user seated on the toilet. The first pocket side section is attached to the central seat section along a first line of perforation, and the second side pocket section is attached to the central section along a second line of perforation. The central seat section is positioned on an upper surface of a toilet seat, and the user to sits on the central seat section. The left side pocket section extends downwardly from the toilet seat to the left of the user proximate the user's left hand, and the right side pocket section extends downwardly from the toilet seat to the right of the user proximate the user's right hand. The user positions his left hand in the left side pocket section, and his right hand in the right side pocket section.

According to another embodiment of the invention, the left and right side pocket sections are removed from the cover by tearing along the first and second lines of perforation. The user can then move his hands freely while maintaining his hands within the side pocket sections. The side pocket sections protect the user's hands from directly contacting the toilet.

DESCRIPTION OF THE PREFERRED EMBODIMENTS OF THE INVENTION AND BEST MODE

Figure 1:
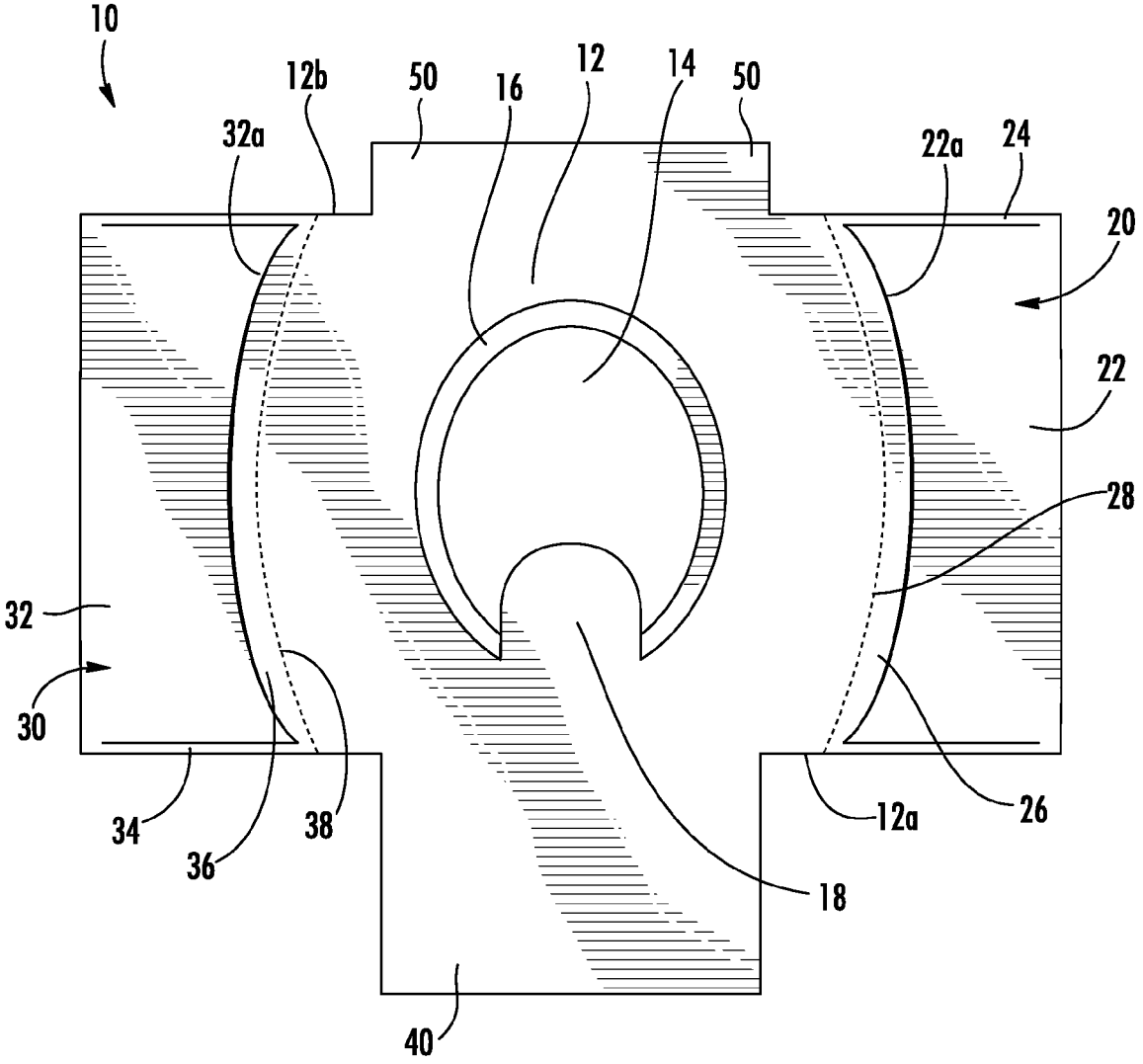
FIG. 1 is a top plan view of a toilet seat cover apparatus according to a preferred embodiment of the invention.

A toilet seat cover according to a preferred embodiment of the invention is illustrated in FIGS. 1-5, and shown generally at reference numeral 10. As shown in FIG. 1, the toilet seat cover 10 comprises a central seat section 12 having an opening 14 formed in the center thereof, a left side pocket section 20 and a right side pocket section 30.

The left and right side pocket sections 20, 30 are connected at left and right sides, respectively, of the central seat section 12. The central seat section 12 includes an inner protective section 16 extending around the central seat opening 14, and an in-bowl flap section 18 positioned at the front of the opening 14, as shown in FIG. 1. A front flap section 40 is connected at the front edge 12*a* of the central seat section 12, and a rear flap section 50 is connected at the rear edge 12*b* of the central seat section 12.

Figure 2:
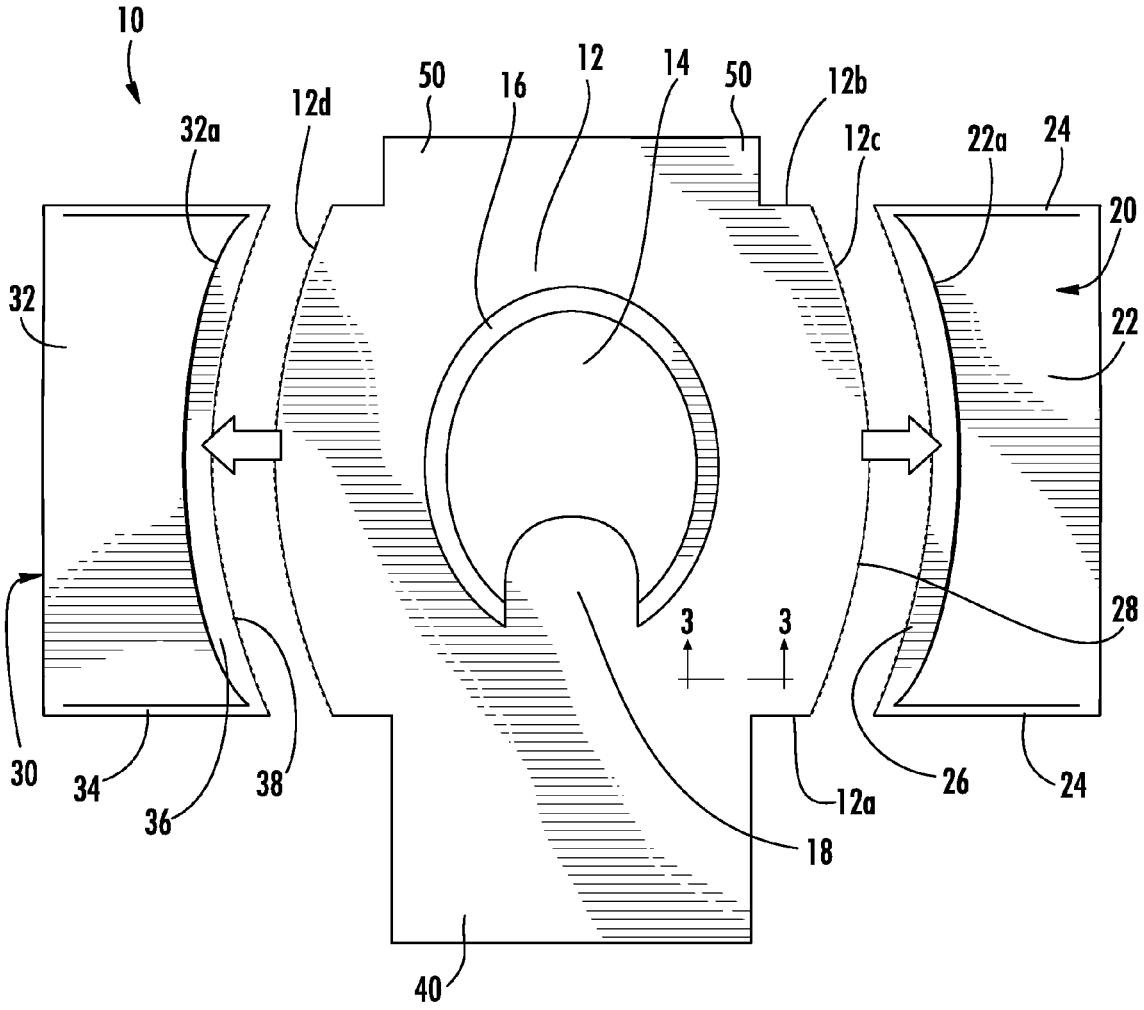
FIG. 2 is another top plan view of the toilet seat cover of FIG. 1.

The left and right side pockets 20, 30 each comprise front panels 22, 32, respectively, attached to back panels 24, 34, respectively, along three sides forming envelopes having top openings 26, 36, respectively, as shown in FIG. 1. The back panels 24, 34 of the side pockets 20, 30 are attached to the central seat section 12 along two contoured lines of perforation 28, 38, respectively, as shown in FIG. 1. The left and right lines of perforations 28, 38 have concave curvatures, and the top edges 22*a*, 32*a* of the front panels 22, 32 of the side pockets 20, 30 have a similar curvature extending substantially parallel to the perforation lines 28, 38. The left and right lines of perforation 28, 38 are positioned closer to the central seat section 12 than the top edges of the 22*a*, 32*a* of the front panels 22, 32, respectively, as shown in FIG. 1. As shown in FIG. 2, the left and right side pockets 20, 30 can be removed from the central seat section 12 by tearing along the lines of perforation 28, 38, respectively.

Figure 3:
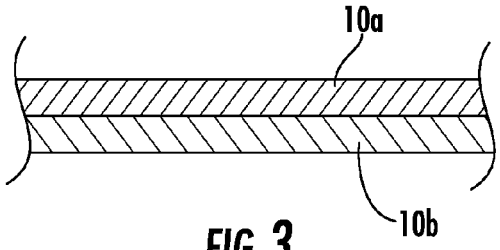
FIG. 3 is a partial cross sectional view of the toilet seat cover taken along lines 3-3 of FIG. 1.

As shown in FIG. 3, the cover 10 is preferably constructed of two layers of material, a top layer 10*a* comprised of a soft a two-ply soft tissue material, such as facial tissue paper, and a bottom layer 10*b* comprised of a water soluble plastic, such as polyvinyl alcohol. As such, the cover 10 can be flushed down the toilet.

Figure 4:
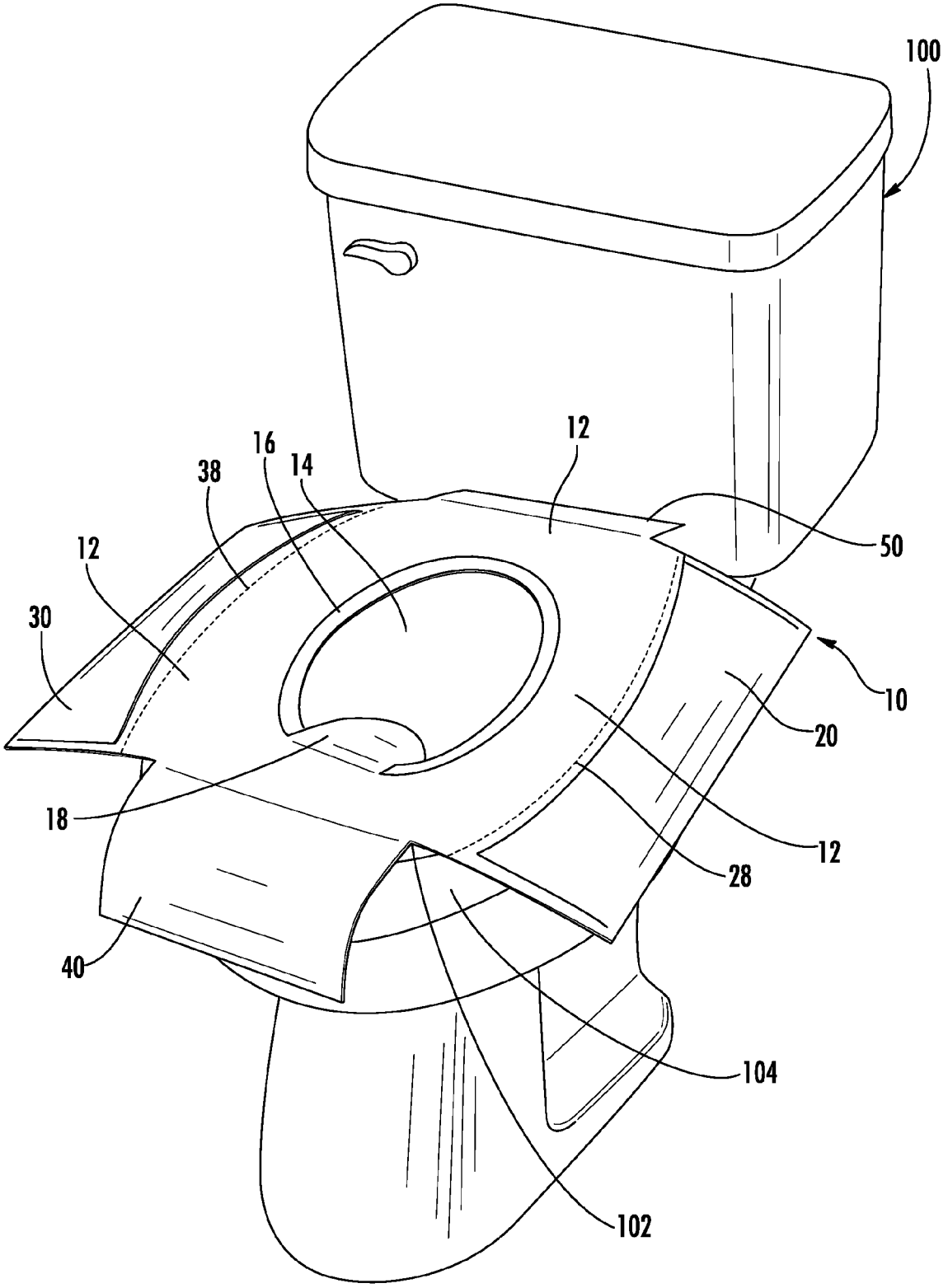
FIG. 4 is an environmental perspective view of the toilet seat cover of FIG. 1.
Figure 5:
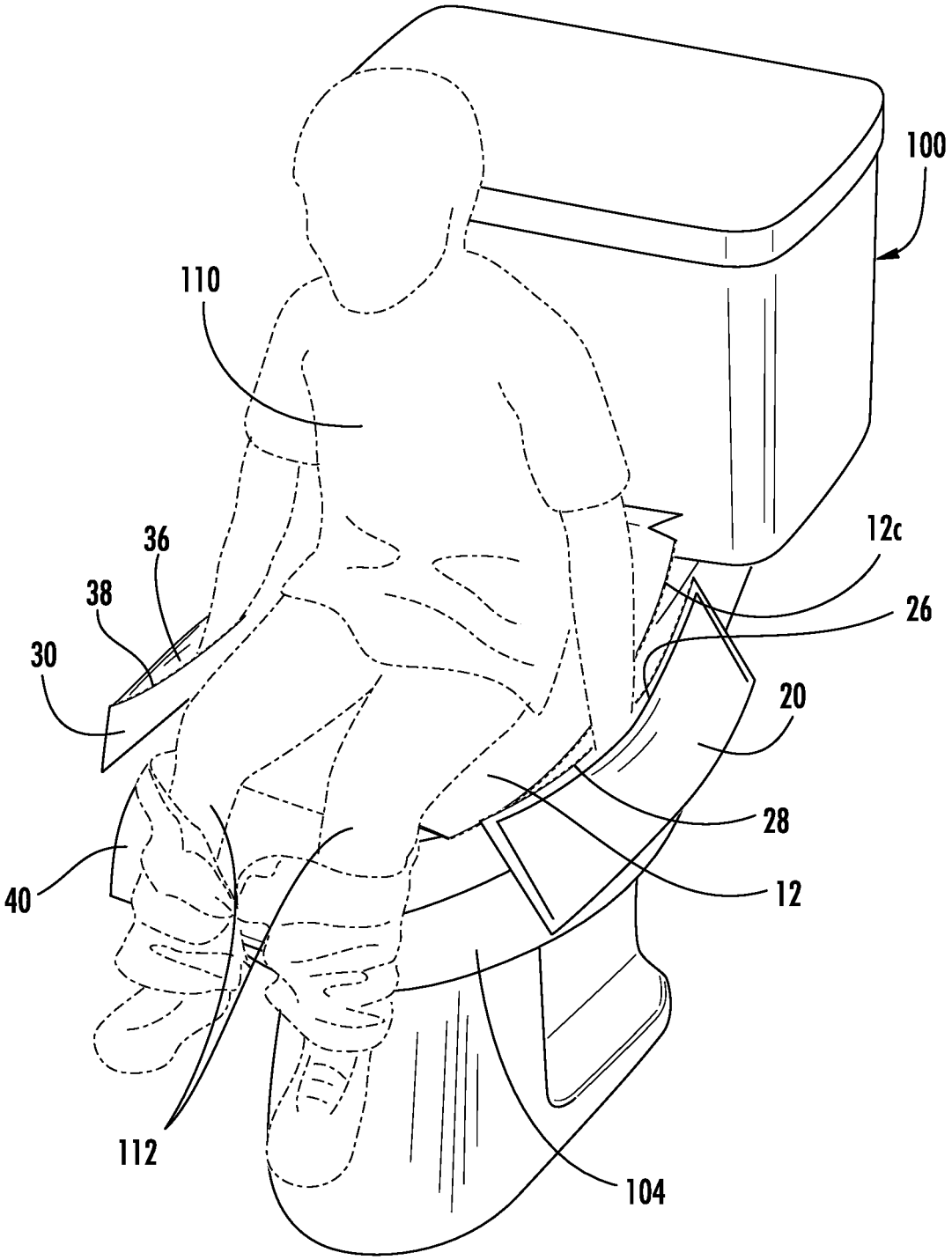
FIG. 5 is another environmental perspective view of the toilet seat cover of FIG. 1.

FIGS. 4 and 5 illustrate a method of using the cover 10 according to a preferred embodiment of the invention. As shown in FIG. 4, the cover 10 can be positioned on a toilet 100. The central seat section 12 is placed directly on the toilet seat 102, with the top layer 10*a* of the cover 10 facing upward and the central seat opening 14 substantially aligned with the toilet opening defined by the toilet seat 102. When the central seat section 12 is so positioned, the side pockets 20, 30 extend downward on left and right sides of the toilet 100, respectively, proximate to the hands of a user 110 seated on the toilet seat 102, as shown in FIGS. 4 and 5.

The user 110 sits on the top layer 10*a* of the central seat section 12. The inner protective section 16 extends downward partially into the interior of the toilet bowl 104, and provides a barrier between the user 110 and the interior of the toilet bowl 104, as shown in FIG. 4. The in-bowl flap 18 extends downward toward the bottom of the interior of the toilet bowl 104 sufficiently to contact the water in the toilet bowl 104 in order to facilitate evacuation of the cover 10 upon flushing of the toilet 100. Alternatively, the in-bowl flap 18 extends partially downwardly into the interior of the toilet bowl to a point where the flap 18 does not contact the water in the toilet bowl 104 when the water is at rest (before and after flushing), but is contacted by the water rushing upon flushing of the toilet 100. As such, the in-bowl flap 18 facilitates evacuation of the cover 10 upon flushing of the toilet, while avoiding unintended flushing that can occur with toilets having automated motion activated flushing mechanisms when toilet seat cover flaps contact the water at rest.

The front flap 40 extends downward from the front edge 12*a* of the seat section 12, covering the front of the toilet 100, and providing a barrier between the legs 112 of a user 110 seated on the toilet 100, as shown in FIG. 5. The rear flap 50 extends from the rear outer edge 12*b* of the central seat section 12, covering an area of the toilet 100 behind the toilet seat 102.

As shown in FIG. 2, the concave perforation lines 28, 38 result in the central seat section 12 having convex side edges 12*c*, 12*d*, respectively, when the side pockets 20, 30 are removed. The convex side edges 12*c*, 12*d* of the central seat section 12 conform to the contour of the toilet seat 102, as shown in FIGS. 2 and 5.

The user 110 can insert his left and right hands through the top openings 26, 36 of the side pockets 20, 30, respectively, and position his hands within the side pockets 20, 30, as shown in FIG. 5. The side pockets 20, 30 can be removed by tearing along the perforated lines 28, 38. The user 110 can then move his hands freely while keeping his hands within the pockets 20, 30, which provide a sanitary barrier between the user's hands and contaminants on the toilet 100. As such, the user 110 can freely move his hands and perform tasks such as flushing the toilet 100, without directly contacting the toilet 100 with his hands.

Alternatively, the side pockets 20, 30 can be attached to the central seat section 12 using other removable attachment means, such as hook and loop fasteners. Also, in other alternative embodiments, the side pockets 20, 30 can have a glove or mitten shaped construction.

A toilet seat cover and a method of using same are described above. Various changes can be made to the invention without departing from its scope. The above description of the preferred embodiments and best mode of the invention are provided for the purpose of illustration only and not limitation—the invention being defined by the following claims and equivalents thereof.

What is claimed is:

1. A cover apparatus for positioning on a toilet comprising:

(a) a central seat section for positioning on a toilet seat, the central seat section having a central opening formed therein for communicating with an interior of a toilet bowl;

(b) first and second side pocket sections connected to the central seat section at opposed positions, wherein the side pocket sections extend downwardly on opposite sides of the toilet when the central seat section is positioned on the toilet seat, each side pocket section adapted for receiving a hand of a user of the apparatus; and (c) wherein the first side pocket section is attached to the central seat section along a first line of perforation and the second side pocket section is attached to the central section along a second line of perforation, whereby the first and second side sections are adapted to be removed from the central seat section by tearing along the first and second lines of perforation.

2. An apparatus according to claim 1, wherein each of the first and second side pocket sections comprise a substantially rectangular envelope comprising a front panel attached to a back panel and having a top opening for receiving the hand of the user.

3. An apparatus according to claim 2, wherein the back panel of the first side pocket section is attached to the central seat section along the first line of perforation, and the back panel of the second side pocket section is attached to the central seat section along the second line of perforation.

4. An apparatus according to claim 1, further comprising a front flap section connected to the central seat section at a front outer edge of the central seat section, wherein the front flap section extends downward when the central seat section is positioned on a toilet seat and provides a barrier between the user's legs and the toilet.

5. An apparatus according to claim 1, wherein the central seat section includes an inner protective section extending around the opening of the central seat section, and extending downward partially into the interior of the toilet bowl when the central seat section is positioned on the toilet seat, whereby the inner protective section provides a barrier between the user and the interior of the toilet bowl.

6. An apparatus according to claim 1, wherein the central seat section includes an in-bowl flap section extending downward proximate a bottom of the interior of the toilet bowl when the central seat section is positioned on a toilet seat, wherein the flap section contacts water in the toilet bowl to facilitate evacuation of the apparatus upon flushing of the toilet.

7. An apparatus according to claim 1, further comprising a rear flap section connected to the central seat section at a rear outer edge of the central seat section.

8. An apparatus according to claim 1, wherein the central seat section and the first and second side sections are comprised of a top layer comprising two-ply soft tissue, and a bottom layer comprising a water soluble plastic.

9. An apparatus according to claim 8, wherein the bottom layer comprises polyvinyl alcohol.

10. A cover apparatus for positioning on a toilet comprising:

(a) a central seat section adapted for positioning on a toilet seat, the central seat section having a central opening formed therein for communicating with an interior of a toilet bowl;

(b) left and right side pocket sections connected to the central seat section at opposed positions, wherein the left side pocket section extends downwardly on a left side of the toilet and the right side pocket section extends downwardly on a right side of the toilet when the central seat section is positioned on the toilet seat, each side pocket section comprising an envelope comprising a front panel attached to a back panel and having a top opening for receiving a hand of a user seated on the toilet; and (c) wherein the back panel of the left side pocket section is attached to the central seat section along a first line of perforation, and the back panel of the right side pocket section is attached to the central seat section along a second line of perforation, whereby the first and second side sections are adapted to be removed from the central seat section by tearing along the first and second lines of perforation.

11. An apparatus according to claim 10, wherein the apparatus is comprised of a top layer comprising two-ply soft tissue, and a bottom layer comprising a water soluble plastic.

12. An apparatus according to claim 11, wherein the bottom layer comprises polyvinyl alcohol.

13. An apparatus according to claim 10, further comprising a front flap section connected to the central seat section at a front outer edge of the central seat section, wherein the front flap section extends downward when the central seat section is positioned on a toilet seat and provides a barrier between the user's legs and the toilet.

14. An apparatus according to claim 13, further comprising a rear flap section connected to the central seat section at a rear outer edge of the central seat section.

15. An apparatus according to claim 14, wherein the left side pocket section, the right side pocket section, the front flap section and the rear flap section are substantially rectangular.

16. An apparatus according to claim 10, wherein the central seat section opening is substantially oval shaped, and the first and second lines of perforation have a concave curvature.

17. An apparatus according to claim 10, wherein the central seat section includes an inner protective section extending around the opening of the central seat section, and extending downward partially into the interior of the toilet bowl when the central seat section is positioned on the toilet seat, whereby the inner protective section provides a barrier between the user and the interior of the toilet bowl.

18. An apparatus according to claim 17, wherein the central seat section includes an in-bowl flap section extending downward proximate a bottom of the interior of the toilet bowl when the central seat section is positioned on a toilet seat, wherein the flap section contacts water in the toilet bowl to facilitate evacuation of the apparatus upon flushing of the toilet.

19. A method of providing a barrier between a toilet and a user seated on the toilet comprising:

(a) providing a toilet seat cover comprising:

(i) a central seat section having an opening formed therein for communicating with an interior of a toilet bowl, (ii) left and right side pocket sections connected to the central seat section at opposed positions, wherein, the side pocket sections extend downwardly on opposite sides of the toilet when the central seat section is positioned on the toilet seat, each side pocket section adapted for receiving a hand of a user seated on the toilet, and (iii) wherein the left pocket side section is attached to the central seat section along a first line of perforation and the right side pocket section is attached to the central section along a second line of perforation;

(b) positioning the central seat section on an upper surface of a toilet seat and allowing the user to sit on the central seat section, whereby the left side pocket section extends downwardly from the toilet seat to the left of the user proximate the user's left hand, and the right side pocket section extends downwardly from the toilet seat to the right of the user proximate the user's right hand; and (c) positioning the left hand of the user in the left side pocket section, and positioning the right hand of the user in the right side pocket section (d) removing the left and right side pocket sections by tearing along the first and second lines of perforation, whereby the user can move his hands freely while maintaining his hands within the side pocket sections.

* * * * *